US005228798A

United States Patent [19]

Tzanovici

[11] Patent Number: 5,228,798

[45] Date of Patent: Jul. 20, 1993

[54] ASSEMBLY COMPRISING TWO COMPONENTS WHICH ARE TELESCOPICALLY CONNECTED TO ONE ANOTHER

[75] Inventor: Alexander Tzanovici, Arolsen, Fed. Rep. of Germany

[73] Assignee: HEWI Heinrich Wilke GmbH, Arolsen, Fed. Rep. of Germany

[21] Appl. No.: 906,856

[22] Filed: Jun. 29, 1992

[30] Foreign Application Priority Data

Jul. 1, 1991 [DE] Fed. Rep. of Germany ..... 4121770

[51] Int. Cl.[5] ..... E05B 3/00

[52] U.S. Cl. ..... 403/362; 292/350

[58] Field of Search ..... 403/362; 292/350, 351

[56] References Cited

U.S. PATENT DOCUMENTS

| | | | |
|---|---|---|---|
| 1,161,521 | 11/1915 | Phillips | 292/350 |
| 1,484,406 | 2/1924 | Ottinger | 292/350 |
| 1,636,364 | 7/1927 | Hoegger | 403/362 X |
| 1,997,686 | 4/1935 | Hoegger | 403/362 X |
| 3,537,736 | 11/1970 | Kroopp | 403/409.1 |
| 4,597,600 | 7/1986 | Wilke et al. | 292/351 X |
| 4,912,809 | 4/1990 | Scheuer | 403/362 X |

FOREIGN PATENT DOCUMENTS

| | | | |
|---|---|---|---|
| 1541573 | 3/1979 | United Kingdom | 403/362 |

*Primary Examiner*—Randolph A. Reese
*Assistant Examiner*—Anthony Knight
*Attorney, Agent, or Firm*—Townsend and Townsend Khourie and Crew

[57] ABSTRACT

Two components are telescopically connected to one another. One component has a radial bore provided with a thread and the other component has a groove which drops away axially. A grub screw is screwed into the bore and the conical tip of the grub screw comes into engagement with the at least one of flanks that form the groove in order to either fix the two components relative to one another or to clamp them axially. In one embodiment, the screw is offset from the base of the groove such that the conical tip rolls against one of the flanks to displace to same and effect telescoping movement between the two components.

16 Claims, 8 Drawing Sheets

ASSEMBLY COMPRISING TWO COMPONENTS WHICH ARE TELESCOPICALLY CONNECTED TO ONE ANOTHER

BACKGROUND OF THE INVENTION

The invention relates to an assembly or arrangement comprising two components which are telescopically connected to one another. One of the components has an externally accessible bore with a thread that extends to the other component perpendicular to the direction of telescoping. A screw with substantially conical tip is screwed into the bore. The other component has, in alignment with the bore, an elongate groove with a cross-section complementary to the conical tip of the screw.

Examples of such arrangements are a door handle provided with a door handle shaft (DE-OS 24 15 905), railing systems with plastic tubes having projecting metal connecting pins or metal sleeves that arc to be axially connected to one another (DE-PS 26 32 696) or carrying bars that are clampable between two walls and contain a spreading pin (DE-PS 26 29 186).

In all these arrangements it is important, after pushing the two components together, to fix them in a specific relative position. In door handle arrangements, for example, a grub screw is screwed into a radial threaded bore of the neck of the door handle and engages into a recess at the end of a door handle shaft that is pushed into a complementary axial channel of the door handle neck (DE-OS 24 15 905). By tapering the recess in the direction in which the door handle neck is withdrawn it is possible to ensure that on pulling axially on the door handle the resistance against the two door handles being pulled apart is increased.

It is also known (DE-AS 26 01 759) to screw a radial grub screw through the neck of a door handle into an axial groove of the door handle shaft, with the depth of the groove decreasing axially outwardly away from the boss of the lock. In this manner increased resistance to pulling off the door handle is also ensured.

A problem in the axial fixation of two telescopically connected components by means of a radial grub screw lies in the fact that the area of contact between the screw and the groove is restricted, in particular with an elongate groove with continuously decreasing or increasing depth, whereby the screw and the groove are heavily loaded in an attempt to draw two parts apart or push them together.

SUMMARY OF THE INVENTION

The object of the invention lies in providing an assembly of two components telescopically connected to one another in which, independently of the depth of the groove and the connection position, the largest possible area of contact is always ensured between the screw and the groove.

In order to satisfy this object the invention provides an assembly comprising two components which are telescopically connected to one another wherein one of said components has an externally accessible bore with a thread which extends to the other component perpendicular to the direction of telescoping, with a screw with a substantially conical tip screwed into the bore, wherein the other component has, in alignment with the bore, an elongate groove with a cross-section complementary to the conical tip of the screw, and wherein the elongate groove extends in the direction of telescoping and has a depth which increases from one end to the other end in the direction of telescoping and in which the screw engages to such a depth that the conical tip presses at least against one of the two flanks and preferably also against the base.

As a result of this design it is ensured that at least one of the flanks of the groove, preferably however both flanks of the groove are in a theoretically linear but in practice areal contact with one another so that it is not only the tip of the screw which enters into the base of the groove but rather the flanks primarily establish the force transmitting contact.

A first embodiment of the invention is characterized by an arrangement in which the tip of the screw and the base of the groove are aligned and the conical tip of the turned-in screw presses against both flanks and preferably also against the base of the groove. In this case the two flanks of the groove are also available for the force transmission from the screw.

In one embodiment the inclination is selected such that on firmly tightening the screw self-locking occurs in the sense that the components which are telescopically connected to one another retain their relative position present during tightening. For this reason the inclination of the base of the groove should be larger than 5°, preferably smaller than 20° and in particular about 10°.

An embodiment of this kind is suitable, for example, for securing door handles to a door handle shaft, providing it is only the position of the door handle relative to the door handle shaft, obtained by pressing the door handle into place, that is to be retained.

The inclination of the groove can however be made so large that on turning in the screw the tip of the screw slides down the inclination of the groove and thereby correspondingly telescopically displaces the components into one another. In this case the inclination must be substantially steeper and can for example be greater than 30°, smaller than 60° and in particular smaller than 45°.

In the embodiment described above the two components can be clamped axially in one direction or the other by tightening the screw depending on the direction in which the groove becomes deeper. In this embodiment the axial pulling apart or pushing together of the components is also more effectively avoided because of the groove which increases much more steeply here.

A second basic and particularly advantageous embodiment is characterized in that the tip of the screw and the base of the groove are fractionally displaced transverse to the direction of telescoping and to the axis of the bore so that on turning in the screw its tip contacts just one flank of the groove, and indeed that flank of the groove which, on turning the screw inwardly, is displaced relative to the component containing the screw in that telescoping direction in which the depth of the groove reduces due to the conical tip of the screw rolling off against it.

Since however the screw is also displaced in its axial direction towards the groove during this rolling off movement the pitch of the thread and the inclination of the base of the groove should be matched to one another so that the pitch of the thread and the inclination of the base of the groove are so matched to one another in such a way that on turning the screw inwardly the tip of the screw moves in the direction of the base of the groove at least by the amount by which the groove becomes deeper through the displacement in the telescoping direction. In other words at the start of contact with the flank the screw should not jam in the groove but should rather first execute the axial roll-off movement. When the two components have been clamped together by the desired amount, and for example contact one another against an abutment, then the screw can be forcibly turned in further whereby the two flanks of the groove also come into engagement with the conical tip of the screw through elastic or plastic deformation.

In the latter two embodiments the inclination of the base of the groove should lie between 10° and 30° and in particular at about 20°.

Since the essentially conical tip of the screw has different peripheral lengths which come into engagement with the planar flanks, depending on the radius, the rolling off process can only take place with a precisely conical tip with partial rubbing of the conical tip at the flank. In order to keep this rubbing minimal the invention provides an embodiment in which the tip of the screw and/or the flanks of the groove are at least partly convexly curved in cross-section perpendicular to the telescoping direction in such a way that on turning in the screw essentially only a restricted peripheral region of the tip in the direction of the screw axis comes into engagement with the associated flank. Here the frictional engagement between the conical tip and the flank is axially restricted.

The axial clamping of the two components can be promoted by arrangement in which engagement means are provided along the periphery of the tip or along a restricted peripheral region of the tip and/or in the flank on which the tip acts and ensure in the telescopic direction an at least partial form fitted connection of the tip and the flank. This embodiment operates not only with frictional engagement but rather also with form fitting engagement between the conical tip and the associated flank.

In order to be as inconspicuous as possible from the outside the grub screw should preferably be an Imbus screw which should have an Imbus key opening for the transmission of the required clamping forces.

In order that the screw can machine itself into the material of the groove in order to increase the frictional engagement it is advantageous to provide an embodiment in which the screw is harder, at least in the region of its tip, than the flanks of the groove.

A first advantageous use of the invention arises in an assembly in which the two components are a door handle that has a nonround axial channel and a bore with a screw, and a bore handle shaft that is complementary to the axial channel and that has a groove.

Alternatively the two telescopically connected components can comprise a plastic tube and a connecting pin, wherein the plastic tube which preferably has a tubular or solid metal core is provided with at least one axial channel and has the bore with the screw at least at one end in the region of the axial channel; wherein the connecting pin, which has a shape complementary to the axial channel has the groove and projects axially from a further plastic tube, preferably a plastic tube having a tubular or solid metal core, and wherein the two plastic tubes directly contact one another axially or are arranged on opposite sides of a leaf, in particular a door leaf having corresponding through apertures and are also secured relative to one another by turning the screw into the groove.

The plastic tubes can be secured relative to one another, with or without substantial axial compression, at the position at which they contact one another.

As a further alternative the two telescopically connected components can comprise a bar and a spreading member, wherein said bar can be inserted between two walls, has an axial channel at at least one end and at least one bore with the screw, and wherein said spreading member has a shape complementary to said the axial channel, and is provided with the said groove.

BRIEF DESCRIPTION OF THE DRAWINGS

The invention will be described in the following by way of example and with reference to the drawings in which are shown.

DESCRIPTION OF THE PREFERRED EMBODIMENTS

Figure 1:
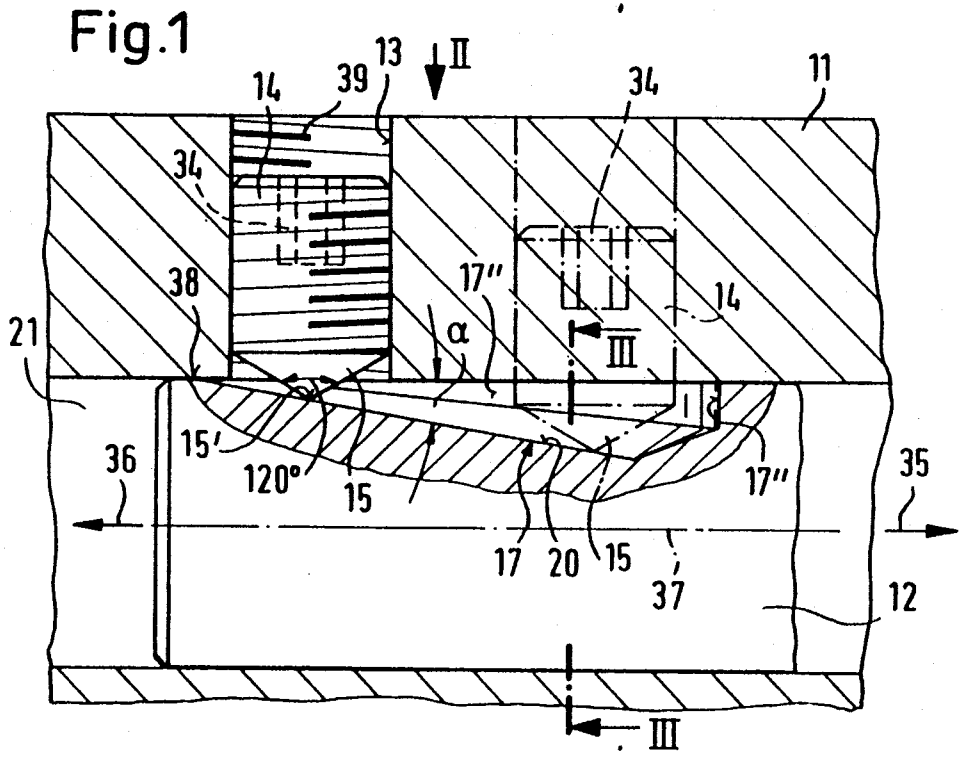
FIG. 1 is a partial section side view of a cutout of a door handle secured to a handle shaft.

As seen in FIG. 1 a neck of a door handle 11 which is only shown by way of indication has an axial channel 21 with a square cross-section in which there is arranged a door handle shaft 12 with a cross-section complementary to the cross-section of the axial channel 21. The non-illustrated boss of the lock is located in the direction of the arrow 35 whereas the door handle provided for actuation is provided in the direction of the arrow 36.

Figure 3:
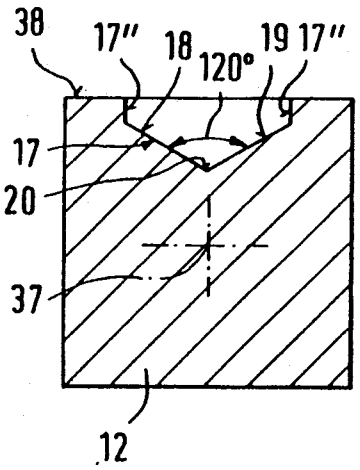
FIG. 3 is a section of the door handle shaft in accordance with the line III—III in FIG. 1.
Figure 2:
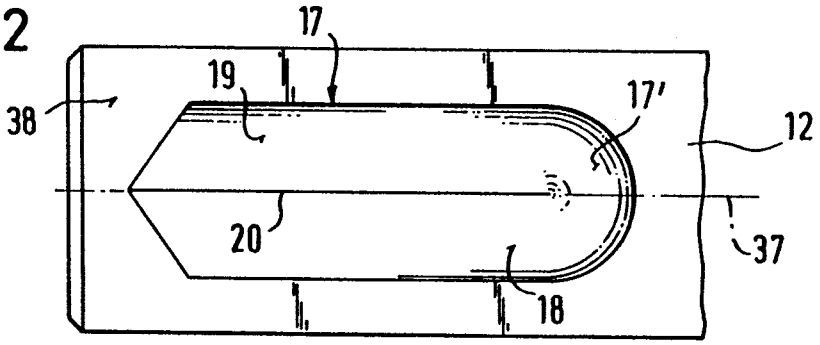
FIG. 2 is a view of only the door handle shaft in accordance with FIG. 1 in the direction of the arrow II in FIG. 1.

In accordance with FIGS. 1 to 3 a groove 17 is provided in the end region of the door handle shaft 12 remote from the lock boss. In the direction of the axis 37 of the door handle shaft 12 the groove 17 has an elongate form which can in particular be seen from FIG. 1 and 2 and which consists essentially of two flanks 18, 19 which are arranged at an angle of 120° (FIG. 3) to one another. The two flat flanks 18, 19 are thus essentially arranged in a V-like manner and meet at a base 20 forming an edge.

The neck of the door handle 11 and the shaft 12 of the door handle are telescopically displaceable relative to one another in the direction of the axis 37. The base 20 of the groove 17 forms an angle $\alpha=10°$ with the telescoping direction, i.e. with the axis 37, so that the groove 17 becomes linearly deeper in the direction 35 toward the lock boss. The deepest end of the groove 17 adjacent to the lock boss 35 is formed as a conical half bore 17'.

At the shallowest end of the groove 17 the flanks 18, 19 merge directly into the surface 38 of the door handle shaft 12 at this position. As the flanks 18, 19 are arranged in all cross-sections at the same angle to one another in accordance with the invention the increasingly higher and vertically extending side flanks 17'' are provided in the deeper regions of the groove 17.

The door handle has a radial bore 13 provided with a thread 39 radially opposite to the groove 17 and a grub screw 14 with a shallow conical tip 15 is screwed into the radial bore and provided with an Imbus opening (hexagonal opening 34). The conical angle of the conical tip 15 amounts 120° and thus corresponds to the angle between the planar flanks 18, 19 of the groove 17.

If, in the position of the door handle 11 relative to the door handle shaft 12 as shown in FIG. 1, the screw 14 is turned downwardly by inserting an Imbus key into the correspondingly shaped polygonal opening 34 and by rotating the Imbus key, then the flanks 18, 19 of the groove 17 enter into a continuous engagement with the conical tip 15 whereas the frontmost point 15' of the tip 15 comes into contact with the base of the groove 20. Through appropriate tightening of the screw 14 a comparatively large contact area is provided between the screw 14 and the door handle shaft 12, and indeed above all when the screw 14 consists of a hard material while the flanks 18, 19 and the base 20 of the groove consist of soft material, so that the tip 15 can bury itself somewhat into the material of the door handle shaft 12.

In the position shown in solid lines in FIG. 1 the screw 14 is near at the beginning of the groove 17, is comparatively shallow.

In the position shown by broken lines another position of the door handle 11 is illustrated in which it has been slid further onto the door handle shaft 12. In this case the screw 14 lies opposite to a substantially deeper part of the groove 17. The screw 14 must therefore be turned substantially deeper into the threaded bore 39 in order to enter into contact with the lower lying flanks 18, 19 or with the base 20 of the groove 17 at this point. On tightening the screw 14 a troublefree and comparatively large area connection is however also established between the door handle 11 and the door handle shaft 12 in the position shown in broken lines.

As a result of the inclination $\alpha$ of the groove 17 it is ensured that on pulling on the handle 11 in the direction of the arrow 36 the connection between the door handle 11 and the shaft 12 of the door handle becomes firmer if anything, firmer because pulling of this kind draws the tip 15 in the direction of the upward slope of the groove 17.

The inclination $\alpha$ is selected in this embodiment of FIG. 1 to 3 to be so small that the screw 14 can be tightened in any relative position of the door handle 11 and of the door handle shaft 12 without the two parts being axially displaced relative to one another.

The inclination $\alpha$ could however also be made substantially steeper in that one for example gives at an angle of 45°. In this case no self-locking would any longer occur and the door handle 11 would be displaced on increasingly tightening the screw 14 so that the screw 14 reaches to increasingly deeper positions of the groove 17. In this manner the door handle 11 and the door handle shaft 12 can be axially clamped relative to one another.

In the following drawings the same reference numerals are used to designate components which correspond to those in FIGS. 1 to 3.

Figure 4:
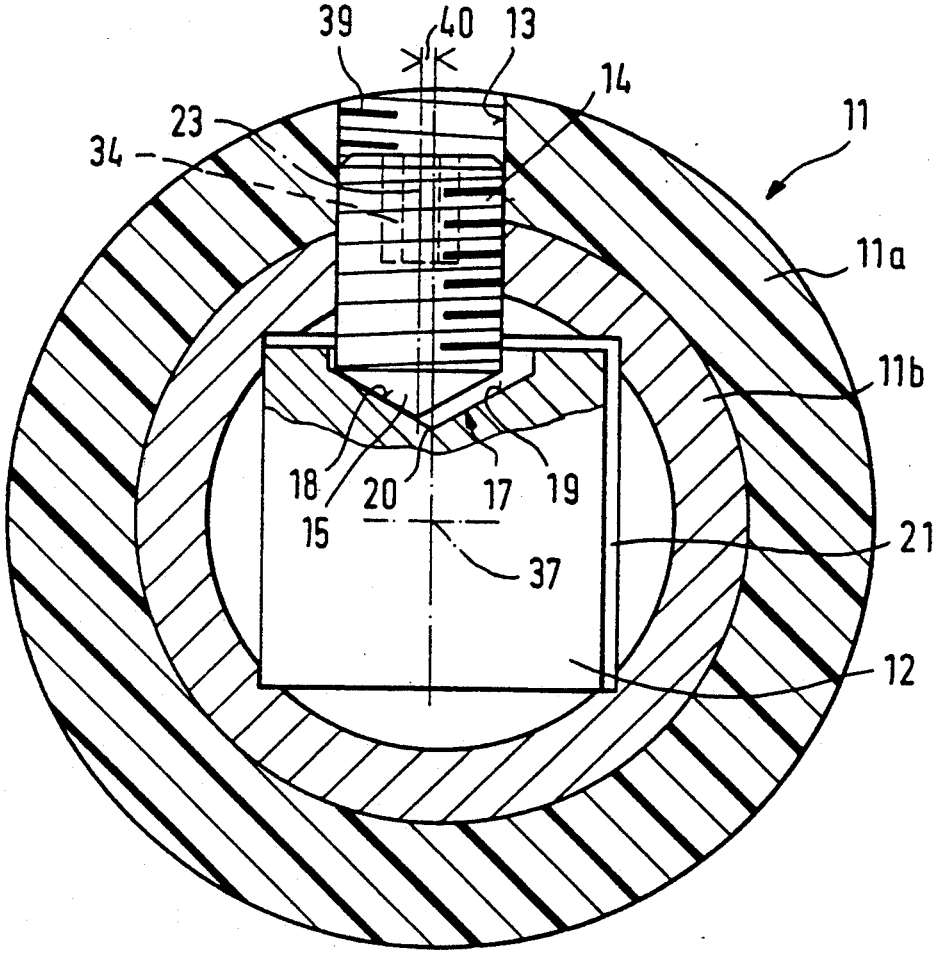
FIG. 4 is an axial section through a door handle neck arranged on a door handle shaft with a mounting device modified relative to FIG. 1 to 3.

In accordance with FIG. 4 the door handle 11 which is shown in cross-section perpendicular to the axis of rotation 37 consists of an outer plastic jacket **11*a* and an inner metal jacket 11*b*. The groove 17 in the one side face of the four-sided door handle shaft 12 is formed precisely as in the FIGS. 1 to 3. In distinction from the embodiment of FIGS. 1 to 3, the axis 23 of the screw 14 is however displaced sideways a small amount indicated by reference numeral 40, relative to the base 20 of the groove in the embodiment of FIG. 4 so that the conical tip 15 first solely engages with the flank 18 of the groove 17**.

For this reason the conical tip 15 rolls on the flank 18 with the door handle shaft 12 being correspondingly displaced in the axial direction. The thread of the screw 14 is now so formed that on the rotation of the screw 14 the door handle 11 is pushed further in the direction of the arrow 35, in the illustration of FIG. 1, onto the door handle shaft 12, with the screw 14 penetrating deeper into the groove 17 in accordance with the increasing depth of the groove. If the door handle normally provided on the other end of the door handle shaft 12 or another abutment strikes the other side of the door then the mutual clamping movement of the door handle 11 and of the door handle shaft 12 ceases and the screw 14 digs itself now somewhat into the material of the flank 18 and indeed preferably until the other flank 19 has also come into engagement with the conical tip 15. In this manner the axial clamping is fixed and the pulling off of the door handle 11 from the door handle shaft 12 in the direction of the arrow 36 (FIG. 1) is effectively avoided.

As the circumference of the conical tip 15 broadens rearwardly continuously from the foremost point 15' a geometrically problem-free roll-off movement on the flank 18 cannot take place with a precise conical formation of the tip 15 in accordance with FIG. 4. Between certain regions of the tip 15 and the flank 18 certain rubbing relative displacements actually arise. As a whole however the roll-off movement which ensures the axial clamping takes place even with exact conical formation of the tip 15.

Figure 5:
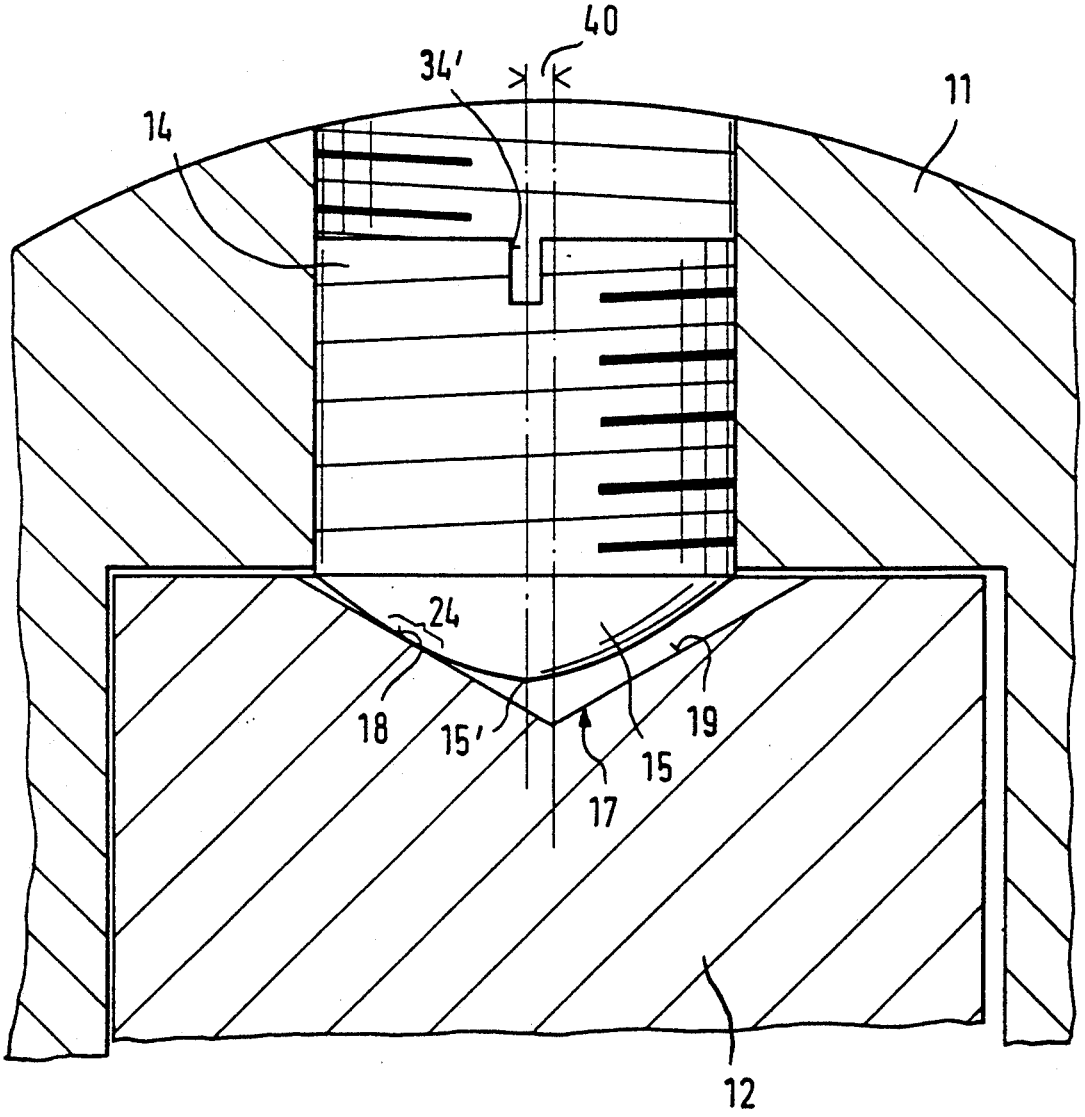
FIG. 5 is a schematic section analogous to that of FIG. 4 but in enlarged scale of an embodiment modified relative to FIG. 4.

In order to ensure a geometrically problem-free roll-off movement one can however, in accordance with FIG. 5, make the approximately conical tip 15 somewhat ball-shaped or convexly curved so that with the displacement 40, which is still present, now as previously, the conical tip 15 contacts the flank 18 along a restricted axial peripheral region 24. The convex curvature should however be so small that on finally tightening the screw 14 the tip 15 digs itself into the softer material of the door handle shaft 12 sufficiently that the tip 15 is finally fully in contact with the flanks 18, 19.

Figure 6:
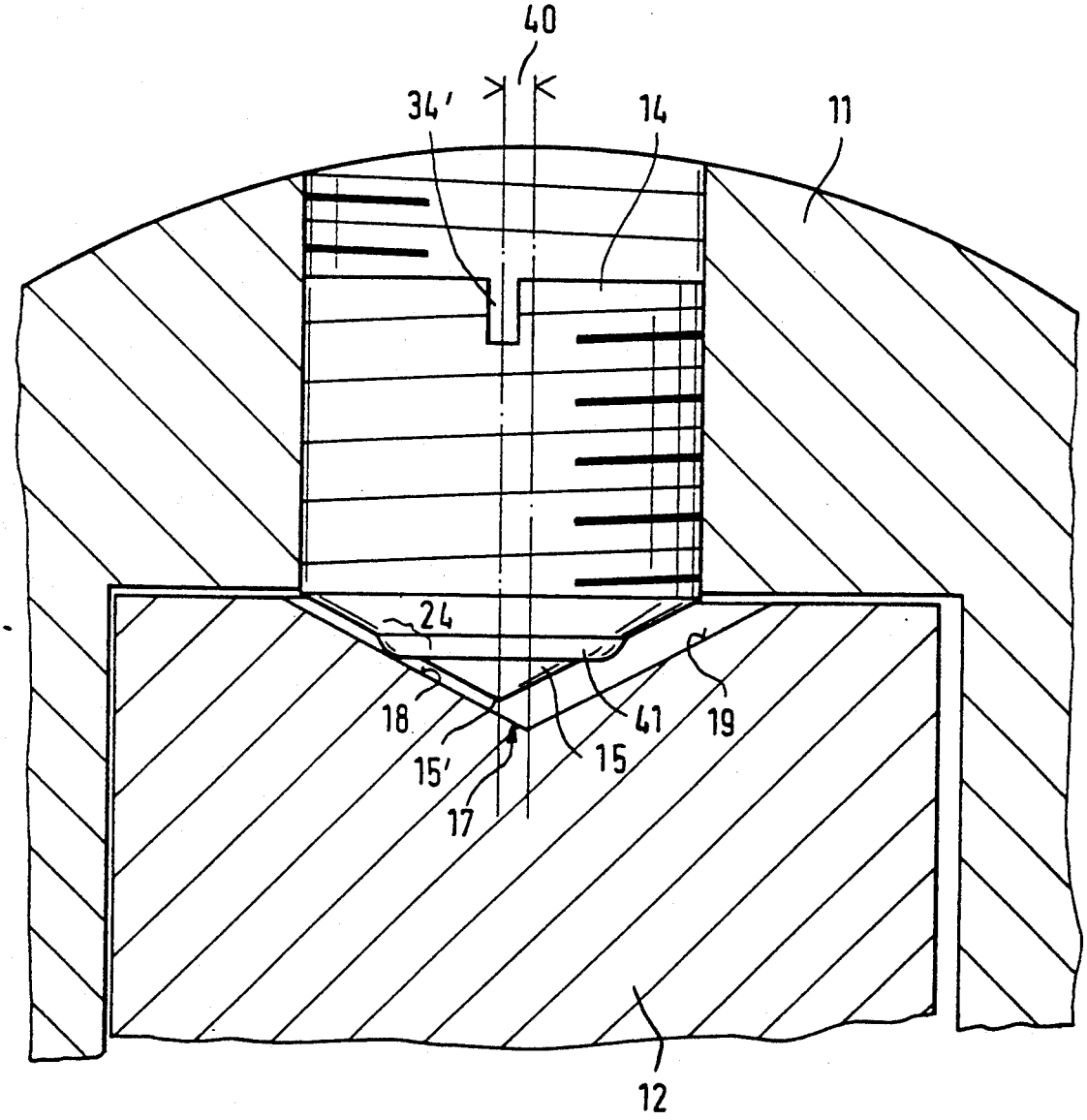
FIG. 6 is a similar section to that of FIG. 5 but of a further embodiment.

In accordance with FIG. 6 the restricted peripheral region 24 can also be realized by a ring bead 41 at the conical tip 15, with the ring bead projecting only a little and then coming into contact with the flank 18. The bead 41 should however project fractionally beyond the conical tip 15 so that on finally tightening the screw 14 the bead 41 digs itself into the material of the door handle shaft 12. In this way the conical tip 15 ultimately fully contacts the two flanks 18, 19 in this embodiment.

Figure 7:
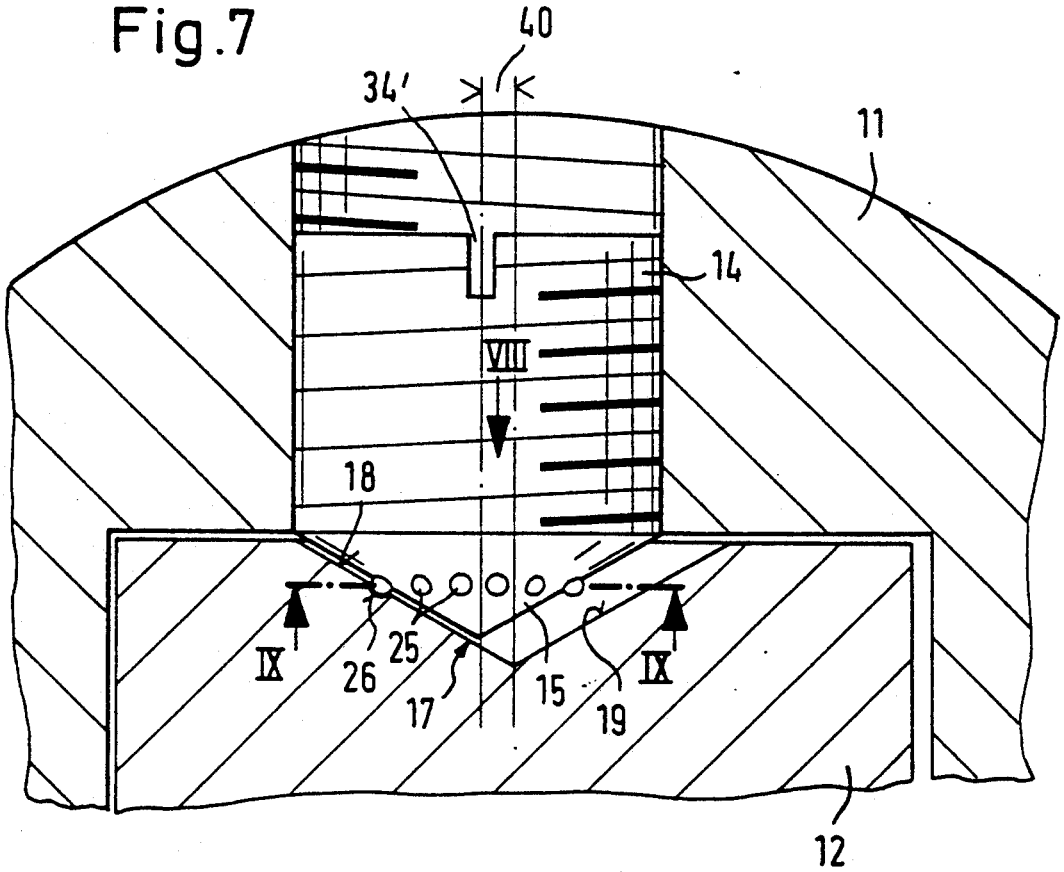
FIG. 7 is a similar section to that of FIG. 5 but of a further modified embodiment.
Figure 8:
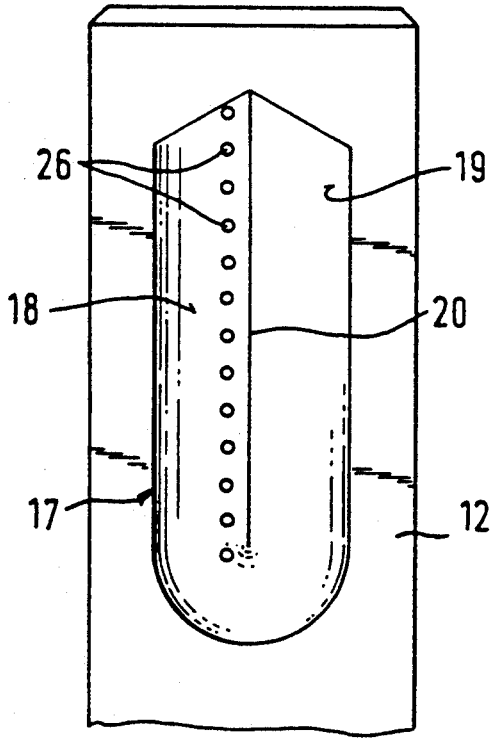
FIG. 8 is a plan view of the door handle shaft of FIG. 7 in the direction of the arrow XIII in FIG. 7, but to a reduced scale.
Figure 9:
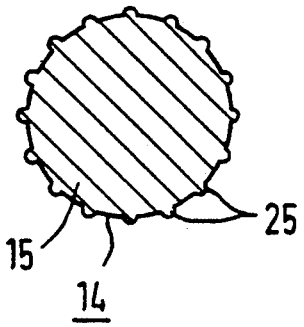
FIG. 9 is a section on the line IX—IX in FIG. 7.

In the embodiment of FIGS. 7 to 9 projections 25 are provided at equal angular intervals at the outer periphery of the conical tip 15 and on turning in or tightening of the screw 14, either dig into the softer material of the door handle shaft 12 or cooperate with corresponding recesses 26 provided in the flank 18 in the manner of a gear tooth connection.

In this way a more pronounced axial clamping force is transmitted to the door handle shaft 12 on tightening of the screw 14. The material of the door handle shaft 12 should however be sufficiently soft that the projections 25 can dig into the material of the groove. This will permit the screw 14 to be turned in further after producing the desired clamping until contact is also achieved with the other flank 19.

In the embodiment of FIGS. 5 and 6 a screw drive slot 34' is provided in the screw 14 in place of the polygonal Imbus opening 34 of FIGS. 1 to 4.

The size of the force transmission from the tool actuating the screw 14 to the door handle shaft 12 can be changed by changing the axial level of the peripheral region 24 (see e.g., FIG. 5), or the ring bead 41 (FIG. 6), or the ring of projections 25 (FIG. 7). The deeper the peripheral region 24 or the ring of projections 25 is arranged along the tip 15, the greater is the axial clamping force which can be transmitted with the tool. In this way, the digging in of the conical tip 15 in the material of the groove 17 can be entered.

Figure 10:
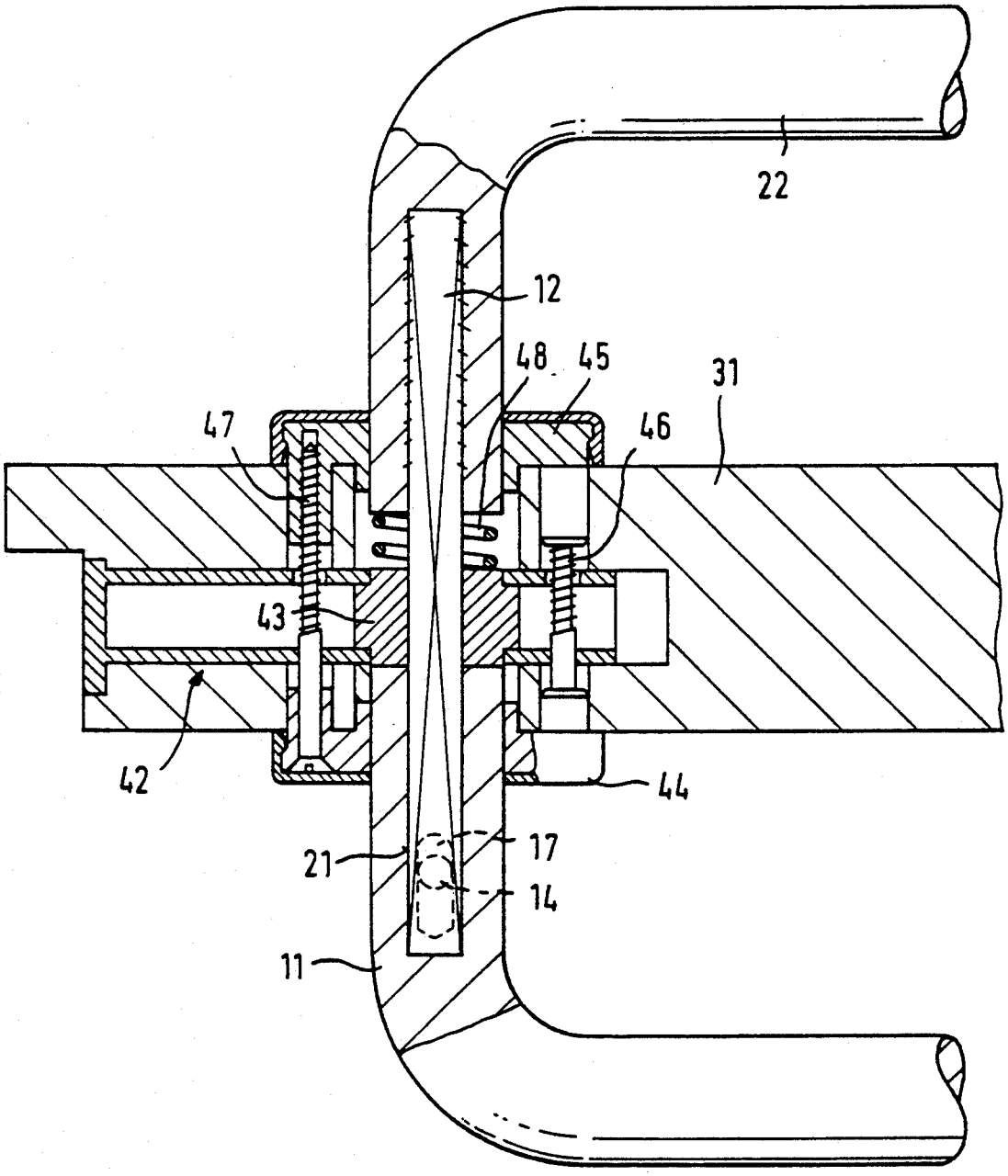
FIG. 10 is a schematic sectional view of a door handle arrangement with the fixing device of the invention.

FIG. 10 shows a door leaf 31 with a lock 42 with a lock boss 43 arranged at one side of the door leaf and with a door handle shaft 12 passing through the lock boss. The door handle 11 has the axial channel 21 for receiving the projecting end of the door handle shaft 12 in which the groove 17 of the invention is provided, with the screw 14 which is only indicated in broken lines lying in the door handle 11 radially opposite to the groove. The opposite end of the door handle shaft 12 is firmly secured in the door handle 22 arranged on the other side of the door leaf 31.

The two door handles 11, 22 are rotationally mounted at their necks in roses 44, 45 in customary manner, with the roses being secured to the door leaf 31 by screws 46, 47.

After a coil spring 48 has been arranged between the neck of the door handle 22 and the boss 43 of the door lock the groove 17 should be as flat as in the embodiment of FIG. 10 as in the embodiment of FIGS. 1 to 3 so that self-locking takes place on turning in of the screw 14.

One could however also omit the coil spring 48 and allow the neck of the door handle 22 to directly contact the boss 43 of the lock. In this case, axial clamping of the two door handles 11, 22 can also be executed through use of the embodiment of FIGS. 4 to 9.

As already mentioned above the axial clamping can be executed not only by the displacement of the screw 14 relative to the groove 17 in accordance with the FIGS. 4 to 9, but also by a very steeply dropping away groove 17. This possibility is illustrated in FIG. 11 with the connection shafts 12''.

Figure 11:
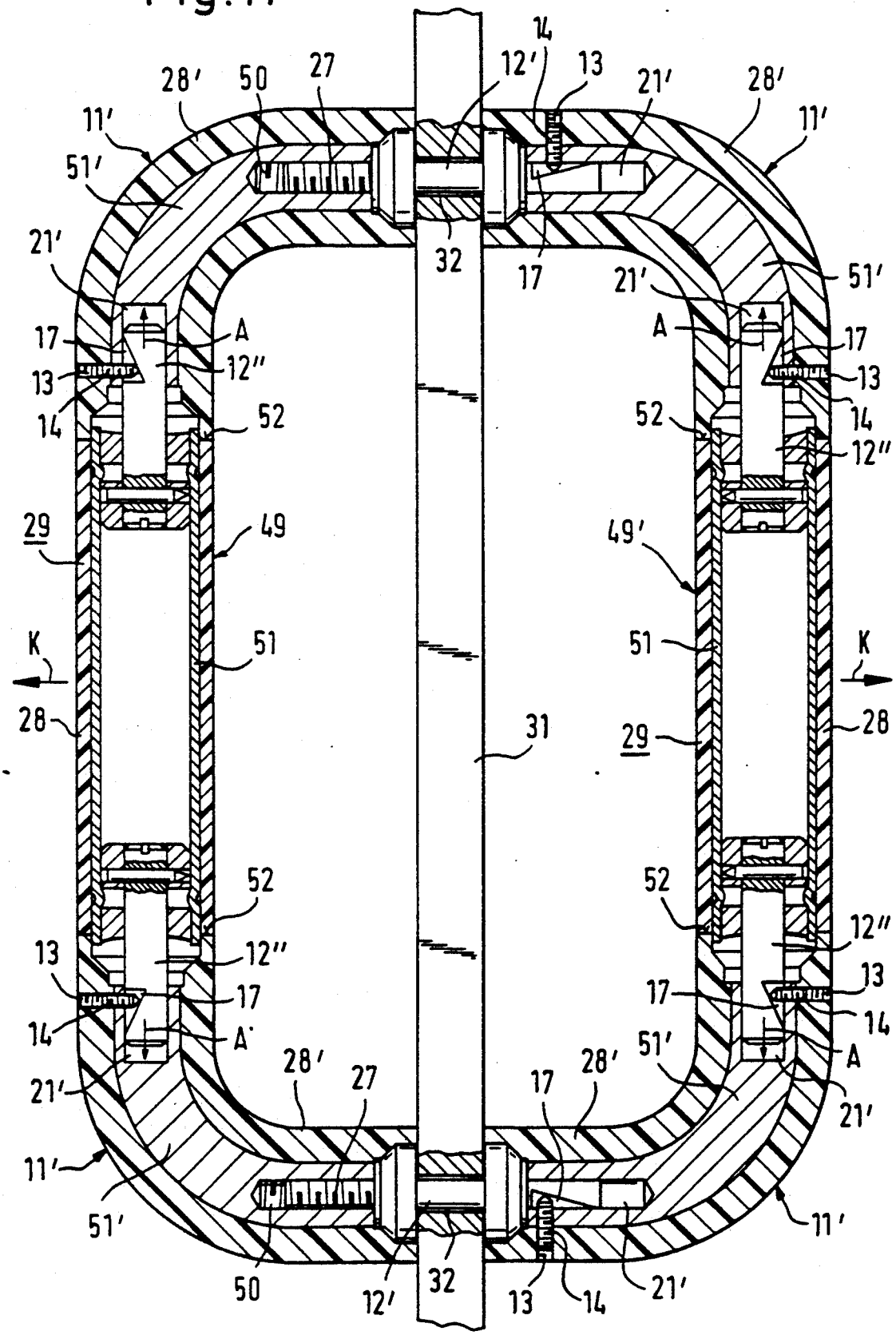
FIG. 11 is a schematic sectional view of two handles arranged on a door leaf which are mounted with the fixing devices of the invention and consist of individual parts which are connected together in accordance with the invention.

FIG. 11 shows two different embodiments of the invention.

U-shaped handles 49, 49' are mounted by means of the inventive securing device to opposite sides of a door leaf 31. For this purpose a connecting shaft 12' extends from each of the limbs of the left hand handle 49 in FIG. 11 through through apertures 32 in the door leaf into a respective axial channel 21' of the opposite handle 49'. The ends of the connecting pins 12' which are located in the left hand handle 49 are provided with threads 27 and can accordingly be screwed to a greater or lesser depth into corresponding threaded bores 15 of the handle 49.

The end of the connecting pin 12' projecting into the axial channel 21' has the groove 17 of the invention at a peripheral side and this groove is engaged by the screw 14 which is threaded into the associated radial bore 13.

As a result of the formation of the groove 17 in accordance with FIGS. 4 to 9 the two handles 49, 49' can be clamped relative to one another or against the door leaf 31 by tightening of the screw 14. Because of the inclined shape of the groove 17 the exertion of considerable tensile forces in the direction of the arrow K is also possible at the same time.

In accordance with the invention each handle 49, 49' comprises a plastic tube 29 with a metal inner tube 51 and a plastic jacket 28.

Connecting pins 12'' which are fixedly connected to the metal tube 51 extend in both directions from the ends of the tube 29 and extend beyond the ends of the tube 29 up to and into axial channels 21' of node elements 11'. In this embodiment the node elements comprise 90° bends which axially follow the tube 29 and which are likewise formed as plastic tubes with a plastic jacket 28' and a solid metal core 51'. Here the connecting pins 12'' have the groove 17 of the invention into which the screw 14 is turned.

In accordance with the invention the groove 17 at the end of the connecting shaft 12'' is substantially steeper than in the preceding embodiments. Thus the screws 14 which are turned into the grooves 17 do not jam in the grooves in self-locking manner but rather they exert, on being tightened in, an axial force A on the connecting shafts 12'' which causes the node elements 11' and the plastic tubes 29 to be pressed against one another at 52. In this manner the node elements 11' and the plastic tubes 29 can be clamped relative to one another with any desired axial clamping force. This is important because the plastic expands through temperature and environmental effects and such an axial clamping must always be executed during manufacture so that a gap cannot open at 52 under any circumstances (for example on reduction of temperature). It is however important that only the plastic jackets 28, 28' contact each other but not however the metal cores 51, 51'.

The axial clamping effect produced by the inclination 17 can be increased by the lateral displacement of the screw 14 and of the groove 17 in accordance with the FIGS. 4 to 9.

Figure 12:
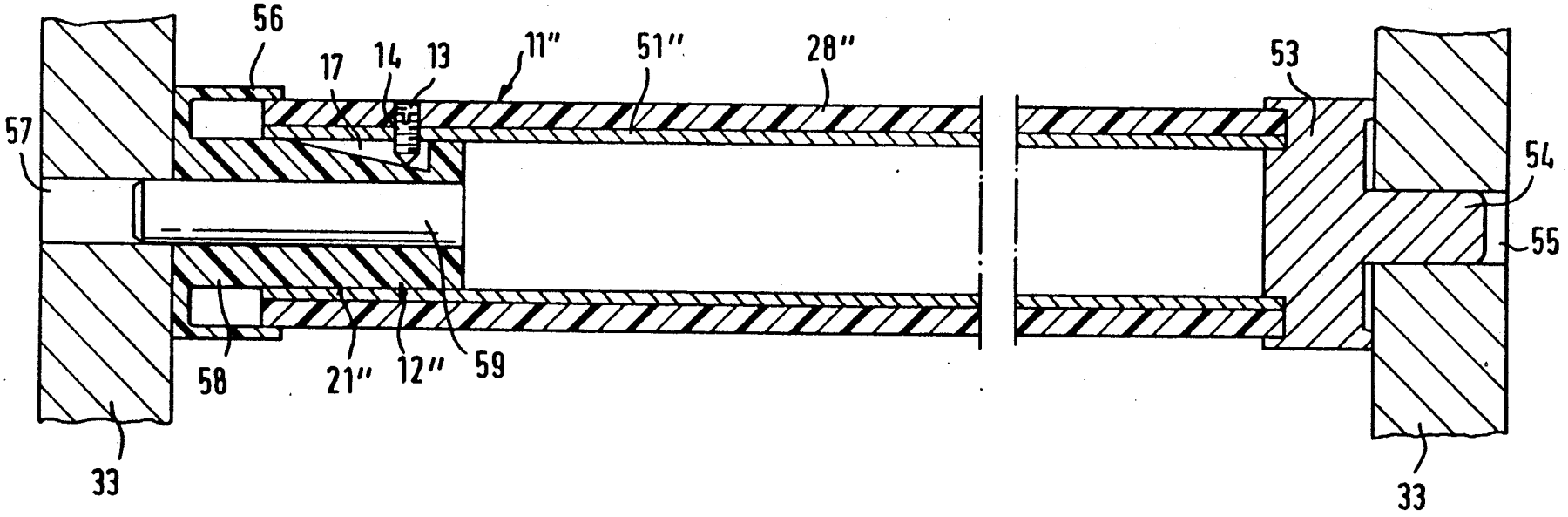
FIG. 12 is a schematic sectional view of a carrying rod arranged between two walls with a spreading device formed in accordance with the invention.

In FIG. 12 the use of the invention is shown for a carrying bar 11'' which is to be arranged between two walls 33.

The carrying bar 11'' which consists of a tubular metal core 51'' and a surrounding plastic jacket 28'' is mounted at one end to the one wall 33 via an intermediate member 53. A projection 54 of the intermediate member 53 thereby engages into a bore 55 of the wall.

At the opposite end a cylindrical spreading member 12''' is axially displaceably arranged with a sliding seat in the inner tube 51'' and is formed as a hollow cylindrical plastic body 58 with an inserted metal pin 59 of smaller diameter and also with a rim 56 which engages the carrying bar 11'' from the outside.

The groove 17 of the invention is located in the plastic body 58 and a screw 14 engages into this groove. The screw is threaded into the radial bore 13 of the carrying bar 11'.

The metal pin 59 of the spreading member 12''' which projects toward the wall 33 extends into a suitable bore 57 of the wall 33.

After the carrying bar 11'' has been brought between the two walls 33 with the spreading member 12''' retracted and with the screw 14 screwed outwardly the screw 14 is turned radially into the bore 13 and, as a result of the formation of the groove 17 in accordance with the FIGS. 4 to 9, the spreading member 12''' is successively extended in the direction of the wall 13. During this the projecting end of the metal pin 58 of the spreading member 12''' extends into the bore 57 and the plastic body 58 contacts the wall 33 so that the carrying bar 11'' is clamped between the two walls 33.

I claim:

1. An assembly comprising two components, said components being telescopically coupled to one another such that they are telescopically displaceable along a telescoping axis, one of said components having an externally accessible bore that extends perpendicular to the telescoping axis and is provided with a thread that extends to the other component, said one of the components further including a screw having a substantially conical tip and being screwed into the bore, the other one of said components having, in alignment with the bore, an elongate groove with a cross-section complementary to the conical tip of the screw, said elongate groove being formed by two flanks which converge at a base, extending in the direction of the telescoping axis, and having a depth which increases from one end to the other end in the direction of the telescoping axis, when said screw is turned to a first position the conical tip of said screw presses against one of the two flanks and the center axis of said screw is displaced from the base of the groove in a direction transverse to the telescoping axis and the center axis of the bore so that on turning the screw for further penetration into the groove, the conical tip rolls against said one of the flanks to displace the same and effect telescoping movement between said two components.

2. An assembly in accordance with claim 1, in which the pitch of the thread and the inclination of the base relative to the telescoping axis are so matched to one another that on turning in the screw the tip of the screw moves in the direction of the base of the groove at least by the amount by which the groove becomes deeper through the displacement in the telescoping direction.

3. An assembly in accordance with claim 2, in which the base of the groove forms an angle with the telescoping axis of about 10° to 30°.

4. An assembly in accordance with claim 3 wherein said angle is about 20°.

5. An assembly in accordance with claim 1, in which the tip of the screw is at least partly convexly curved in cross-section perpendicular to the telescoping direction in such a way that on turning in the screw essentially only a restricted peripheral region of the tip in the direction of the center axis of the screw comes into engagement with said one of the flanks.

6. An assembly in accordance with claim 1, in which means for providing engagement between said tip and said one of the flanks are provided along the periphery of the tip.

7. An assembly in accordance with claim 6, in which said engagement means extends over a restricted peripheral portion of said conical tip.

8. An assembly in accordance with claim 1, in which the screw is a grub screw having a hexagonal socket.

9. An assembly in accordance with claim 1, in which the screw is harder, at least in the region of its tip, than the flanks of the groove.

10. An assembly in accordance with claim 1, in which the two components which are telescopically coupled to one another are a door handle and a door handle shaft, said door handle including a non-round axial channel and said bore in which said screw is positioned, said door handle shaft having a configuration complementary to the axial channel and including said groove.

11. An assembly in accordance with claim 1, in which the two components which are telescopically coupled together are a plastic tube and a connecting pin, wherein the plastic tube includes a core, is provided with at least one axial channel and has said bore with said screw therein at one end in the region of the axial channel, the connecting pin, which has a shape complementary to the axial channel has the groove and projects axially from a further plastic tube having a core, and wherein the two plastic tubes are secured relative to one another by turning the screw into the groove.

12. An assembly in accordance with claim 11, wherein said plastic tubes are secured relative to one another without substantial axial compression.

13. An assembly in accordance with claim 11, wherein said plastic tubes are secured relative to one another with substantial axial compression of said plastic tubes at the position at which they contact one another.

14. An assembly in accordance with claim 1, in which the two components which are telescopically coupled to one another are a bar and a spreading member, said bar having an axial channel at one end and including said bore with screw positioned therein, said spreading member having a shape complementary to said axial channel, and being provided with said groove.

15. An assembly in accordance with claim 1, in which the flanks of the groove are at least partly convexly curved in cross-section perpendicular to the telescoping direction in such a way that on turning in the screw essentially only a restricted peripheral region of the tip in the direction of the center axis of the screw comes into engagement with associated flank.

16. An assembly in accordance with claim 1 in which means for providing limited engagement between said tip and one flank are provided on said one flank.

* * * * *